US006010835A

United States Patent [19]

Thomas et al.

[11] Patent Number: 6,010,835

[45] Date of Patent: Jan. 4, 2000

[54] KIT FOR PHOTOGRAPHIC COLOR DEVELOPING BATH

[75] Inventors: Francoise M. Thomas; Philippe Strauel; Claude G. Goumont, all of Chalon sur Saone Cedex, France

[73] Assignee: Eastman Kodak Company, Rochester, N.Y.

[21] Appl. No.: 09/285,158

[22] Filed: Apr. 1, 1999

[30] Foreign Application Priority Data

Apr. 3, 1998 [FR] France ..... 9804400

[51] Int. Cl.[7] ..... G03C 7/413

[52] U.S. Cl. ..... 430/466; 430/486; 430/490

[58] Field of Search ..... 430/466, 486, 430/490

[56] References Cited

U.S. PATENT DOCUMENTS

| | | | |
|---|---|---|---|
| 3,647,461 | 3/1972 | Surash et al. | 430/466 |
| 3,790,381 | 2/1974 | Fisch et al. | 430/466 |
| 4,232,113 | 11/1980 | Marchesano | 430/466 |
| 5,843,630 | 12/1998 | Masson | 430/466 |

*Primary Examiner*—Hoa Van Le
*Attorney, Agent, or Firm*—J. Lanny Tucker

[57] ABSTRACT

This invention relates to a 3-part kit preparing for a photographic developing bath for the processing of color photographic materials. The kit of this invention affords an efficient ready-to-use developing solution.

5 Claims, No Drawings

KIT FOR PHOTOGRAPHIC COLOR DEVELOPING BATH

FIELD OF THE INVENTION

This invention relates to a kit for photographic color developing bath for use in the processing of color photographic materials, and to a method for the preparation of a developing bath from said kit.

BACKGROUND OF THE INVENTION

In the processing of color photographic films, color developing baths are used that comprise as their main component a color developing agent in an alkaline solution. These color developing baths also comprise additional components such as permeability agents, antifoggants, preservatives, etc.

Procedures exist whereby the different components of a color developer solution are supplied separately in kit form. Such photographic processing kits are generally made up of two or three items that each contain one or more components of the final bath. These different items are mixed by the end user to obtain a color developing bath that is ready for use. Provision of such kit forms is desirable because the different components of the color developing bath are unstable when they are present together in the same solution.

For the processing of motion picture films, there exists a kit containing two concentrated solutions, called concentrates, one of which contains an alkali, and the other a developing agent, and a solid component, which is 3,5-dinitrobenzoic acid in a damp powder form. This form makes automated manufacture of the kit problematic because the powder component is difficult to handle industrially.

In addition, to obtain a color developing bath from these two liquid concentrates and the solid component, these three kit items have to be mixed in a set order for the powder to dissolve completely. Photographic processing kits are intended to enable non-specialist end users to prepare ready-to-use developing baths more easily.

SUMMARY OF THE INVENTION

It is an object of this invention to provide a kit for a color developing bath in a simpler form that allows easier industrial production of the kit. Another object of the invention is to supply the end user with a kit that allows simple, reproducible, and rapid preparation of a ready-to-use color developing bath. Another object of the invention is to provide a kit allowing an efficient color developing bath to be obtained.

This object is achieved according to this invention, which relates to a kit for a photographic developing bath comprising three concentrates (A), (B), and (C), where concentrate (A) is an aqueous basic solution with a pH higher than 8, concentrate (B) is an aqueous acid solution containing a paraphenylenediamine color developing agent, and concentrate (C) is a homogeneous aqueous solution comprising a compound with formula (I) and a compound with formula (II).

(I)

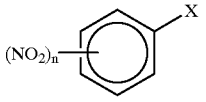

-continued (II)

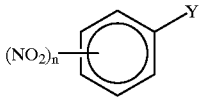

where compounds (I) and (II) differ only in the groups X and Y; X is —COOH or —$SO_3H$ with the proviso that when X is —COOH, Y is —COOM, and when X is —$SO_3H$, Y is —$SO_3M$, M being selected from the group comprising sodium, potassium, lithium or ammonium; n is 1 or 2; the redox potential of compounds I and II is higher than −700 mV; the total concentration (Ct) of compounds (I) and (II) in concentrate (C) is higher than the solubility (SI) of compound (I) in concentrate (C) and lower than the solubility (SII) of compound (II) in concentrate (C); the pH of concentrate (C) is higher than pKa+Log((Ct−S(I))/S(I)).

The redox potential of compounds (I) and (II) is given relative to a Ag/AgCl/KCl 3M reference electrode.

The invention also relates to the use of this kit to prepare a color developing bath, and to a method to prepare a ready-to-use color developing bath by mixing concentrates (A), (B) and (C) in the kit of this invention in any order.

DETAILED DESCRIPTION OF THE INVENTION

In the scope of this invention, the compound with formula (I) can be any of the following; 3,5-dinitrobenzoic acid (redox potential −480 mV), 2,4-dinitrobenzene sulfonic acid (redox potential −460 mV), 3-nitrobenzoic acid (redox potential −650 mV), 4-nitrobenzoic acid (redox potential −580 mV), or 3-nitrobenzene sulfonic acid (redox potential −600 mV). The compound with formula (II) is a sodium, potassium or lithium salt of one of these acids. In a specific embodiment, compound (I) is 3,5-dinitrobenzoic acid and compound (II) is a salt of this acid.

In all cases the volume and the concentration of concentrate (C) are adjusted to obtain a ready-to-use developing bath containing at least $10^{-4}$ mol/l of compounds (I) and (II).

In a specific embodiment, concentrate (C) comprises free 3,5-dinitrobenzoic acid and sodium 3,5-dinitrobenzoate, and the total concentration of the free acid and its salt is from $5\times10^{-2}$ mol/l to $9\times10^{-2}$ mol/l.

In a specific embodiment, the total concentration of free 3,5-dinitrobenzoic acid and sodium 3,5-dinitrobenzoate in concentrate (C) is about 0.08 mol/l. In this case the pH of concentrate (C) is maintained in the acid range, preferably between 4 and 5.

In another embodiment, concentrate (C) comprises free 3,5-dinitrobenzoic acid and lithium 3,5-dinitrobenzoate, and the total concentration of the free acid and salt is from 0.1 mol/l to 0.3 mol/l.

The kit of this invention is particularly easy to manufacture because it comprises three liquid concentrates. It allows fast and easy preparation of a ready-to-use color developing bath by the end user. In addition, it affords good sensitometric properties for the processed photographic materials, especially low fogging with no loss of speed.

In the scope of this invention, concentrate (A) is a basic solution obtained using alkaline compounds such as sodium or potassium carbonate, borax, sodium or potassium hydroxide, or sodium metaborate in aqueous solution. Concentrate (A) can contain sequestering agents, calcium complexing agents such as aminopolycarboxylic acids, e.g., ethylenediaminetetraacetic acid (EDTA), diethylenetriaminepentaacetic acid (DTPA), isopropanoldiaminetetraacetic acid (DPTA), aminopolyphosphonic acids, e.g., amino-N,N-dimethylenephosphonic acids, hexametaphosphate, Dequest® (2000, 2006, 2010, etc.), or Versenex 80®.

The volume and the pH of concentrate (A) are adjusted to obtain a ready-to-use developing bath with a pH of at least 8, and preferably between 10 and 12.

The developing agent used in concentrate (B) is generally a p-phenylenediamine, e.g., 2-amino-5-diethylaminotoluene (known as CD2), 4-amino-N-ethyl-N-(β-methanesulfoamidoethyl)-m-toluidine (CD3), or 4-amino-3-methyl-N-ethyl-N-(β-hydroxyethyl)-aniline (CD4). CD2 is generally used in color developing baths for positive motion picture films, and CD3 is generally used in color developing baths for negative motion picture films and intermediate motion picture films.

The concentration of developing agent and the volume of concentrate (B) are adjusted to obtain a ready-to-use developing bath with a concentration of developing agent of at least $7\times10^{-3}$ mol/l, preferably from $9\times10^{-3}$ to $2\times10^{-2}$ mol/l.

Concentrate (B) containing the color developing agent can contain other compounds such as for example antioxidants or surfactants. The antioxidants that can be used in concentrate (B) are for example alkali metal sulfites, metabisulfites or bisulfites, sulfur-containing compounds that generate sulfite ions in aqueous solutions, ascorbic acid and its derivatives, etc.

In a specific embodiment, concentrate (B) comprises CD3 as developing agent, and sulfite. The pH of this concentrate is kept acid, preferably between 2.5 and 3.5.

These concentrates are mixed at the time of use either to prepare a developing bath, or to prepare a replenishment solution to maintain the efficiency of the developing bath during its use. In the scope of the invention, the three concentrates can be mixed in any order. To make the preparation of the ready-to-use developing bath even easier, the volumes and the concentrations of concentrates (A), (B), and (C) can be set such that mixing the three concentrates affords one liter of color developer solution, without having to dilute the mixture.

Concentrates (A), (B), and (C) can contain other compounds, for example, antiseptics, heat stabilizers, development activators such as thioethers or oxothioethers, or benzylamine.

After the three concentrates have been mixed it may be necessary to adjust the pH to a value preferably from 10.0 to 11.0 to obtain a ready-to-use color developing bath.

In a specific embodiment, the kit of this invention is designed for the preparation of a color developing bath for negative motion picture films such as Eastman Color Negative® marketed by Kodak. Conventionally, this process comprises a color development step in the presence of CD3, a bleaching step, and a fixing step. The bleaching step and the fixing step can be replaced by a single bleach-fixing step. Between each of these steps one or more washing steps can be inserted.

This invention is illustrated by the following examples:

EXAMPLE 1

Preparation of Concentrate C

In a vessel fitted with a magnetic stirrer containing 850 ml of distilled water was added 100 ml of a solution of sodium hydroxide (0.0875 mole). To this solution, with stirring, was added 17 g (0.08 mol.) of 3,5-dinitrobenzoic acid (12, 125-8) supplied by Aldrich in dry powder form. This solution was stirred for 30 min. until the 3,5-dinitrobenzoic acid was completely dissolved. To this solution was added demineralized water to obtain 1 liter of solution. The pH was then adjusted to 4.5 by addition of acetic acid.

Concentrate (C) was thereby obtained, containing free 3,5-dinitrobenzoic acid and its sodium salt.

EXAMPLE 2

Concentrate (C) was prepared by the procedure described in Example 1 from 17 g/l (0.08 mol/l) of 3,5-dinitrobenzoic acid. The pH of the solution was adjusted to 5. The concentrate was maintained at 60° C. for 45 days. Samples of concentrate were taken on days 4, 8, 21 and 45 and the total quantity of remaining 3,5-dinitrobenzoic acid was measured (quantity of salt+quantity of free acid). The table below gives the time course of the variation in the concentration of 3,5-dinitrobenzoic acid (in percent) from day 0 (freshly prepared solution) to day 45. The concentration of 3,5-dinitrobenzoic acid was measured by HPLC (variability of the measurement±2%).

The following results were obtained:

| Day | Variation of 3,5-dinitrobenzene concentration | pH |
|---|---|---|
| 0 | — | 5.06 |
| 4 | 0.01% | 5.01 |
| 8 | 0.05% | 5.01 |
| 21 | 0.3% | 5.01 |
| 45 | 1.17% | 5.02 |

EXAMPLE 3

In this example, 1 liter of ready-to-use developing solution was prepared from concentrate (C) prepared previously, a concentrate (A), and a concentrate (B) with the following composition.

| | |
|---|---|
| Concentrate A (1 liter) | |
| Demineralized water | 950 ml |
| Sequestering agent Dequest 2006 ® | 19.3 g |
| Sodium bromide | 4.02 g |
| Sodium carbonate, $H_2O$ | 147.2 g |
| Sodium bicarbonate | 3.02 g |
| pH at 25° C. | 10.8 |
| Concentrate B (1 liter) | |
| Demineralized water | 912 ml |
| Anhydrous sodium sulfite | 52.9 g |
| CD3 | 116.3 g |
| pH at 25° C. | 3 |

One liter of ready-to-use developing solution was obtained by mixing 198.5 ml of concentrate (A), 47.25 ml of concentrate (B) and 34 ml of the concentrate (C) of Example 1.

An Eastman Color Intermediate 2244® color negative film was exposed through a sensitometric 21 step wedge, each range having an increment of 0.15LogE with an exposure light of color temperature 2850° K and an HA50 and F1500 filter for 1/10 sec. It was developed using photographic process ECN-2®, which comprised the developing bath prepared in example 3, a bleaching bath, a fixing bath, and a final washing bath, the film and the process being marketed by Kodak.

The following sensitometric results were obtained by reading in the three colors blue, green and red on a densitometer.

| | Red-sensitive layer | Green-sensitive layer | Blue-sensitive layer |
|---|---|---|---|
| Dmin | 0.053 (0.061) | 0.53 (0.629) | 0.62 (0.62) |
| Dmax | 2.3 (2.3) | 2.9 (2.9) | 2.9 (2.9) |
| Contrast | 0.93 (0.94) | 0.98 (0.95) | 0.99 (0.99) |
| Speed | 181 (182) | 196 (191) | 169 (170) |

(): Value obtained when the developing bath contained no 3,5-dinitrobenzoic acid.
Dmin = minimum density corresponding to part of the unexposed film (support + fog).
Dmax = maximum density of film.
Speed = 100(3-LogE), E being the exposure at point of density Dmin + 1.
Contrast = slope of the straight line between point of density Dmin + 0.20 and that of exposure higher than 1.35 LogE.

The invention has been described in detail with particular reference to certain preferred embodiments thereof, but it will be understood that variations and modifications can be effected within the spirit and scope of the invention.

We claim:

1. A kit for photographic developing bath comprising three concentrates, (A), (B) and (C), wherein:

concentrate (A) is an aqueous basic solution with pH higher than 8, concentrate (B) is an aqueous acid solution containing a paraphenylenediamine color developing agent, and concentrate (C) is a homogeneous aqueous solution containing a compound with formula (I) and a compound with formula (II)

(I)

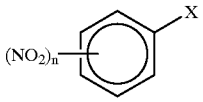

-continued (II)

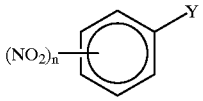

in which said compounds (I) and (II) differ only in the groups X and Y; X is —COOH or —$SO_3H$ and when X is —COOH, Y is —COOM, and when X is —$SO_3H$, Y is —$SO_3M$, where M is selected from among sodium, potassium, lithium or ammonium; n is 1 or 2; the redox potential of compounds (I) and (II) is higher than −700 mV; the total concentration (Ct) of compounds (I) and (II) in concentrate (C) is higher than the solubility (SI) of compound (I) in concentrate (C) and lower than the solubility (SII) of compound (II) in concentrate (C), and the pH is higher than pKa+Log((Ct−S(I))/S(I)).

2. The kit of claim 1 wherein the compound with formula (I) is 3,5-dinitrobenzoic acid, 2,4-dinitrobenzene sulfonic acid, 3-nitrobenzoic acid, 4-nitrobenzoic acid, 3-nitrobenzene sulfonic acid, and the compound of formula (II) is a sodium, potassium or lithium salt of the corresponding acid.

3. The kit of claim 1 wherein said concentrate (C) comprises free 3,5-dinitrobenzoic acid and sodium 3,5-dinitrobenzoate, and the concentration of compounds (I) and (II) is from $5\times10^{-2}$ to $9\times10^{-2}$ mol/l.

4. The kit of claim 1 wherein said concentrate (C) comprises free 3,5-dinitrobenzoic acid and lithium 3,5-dinitrobenzoate, and the concentration of compounds (I) (II) (II) is between 0.1 mol/l and 0.3 mol/l.

5. A method of preparation of a photographic developing bath comprising mixing concentrates (A), (B), and (C) of the kit of claim 1, in any order.

* * * * *